US005723810A

United States Patent [19]

Sauvestre

[11] Patent Number: 5,723,810

[45] Date of Patent: Mar. 3, 1998

[54] DOUBLE-PENETRATION REDUCED-RANGE HUNTING BULLET

[76] Inventor: Jean-Claude Sauvestre, 64 rue de la Vallee, 18230 Saint-Doulchard, France

[21] Appl. No.: 640,856

[22] PCT Filed: Sep. 13, 1995

[86] PCT No.: PCT/FR95/01170

§ 371 Date: Jun. 27, 1996

§ 102(e) Date: Jun. 27, 1996

[87] PCT Pub. No.: WO96/08689

PCT Pub. Date: Mar. 21, 1996

[30] Foreign Application Priority Data

Sep. 13, 1994 [FR] France ..... 94 10922

[51] Int. Cl.[6] ..... F42B 5/02; F42B 12/00

[52] U.S. Cl. ..... 102/439; 102/506; 102/517; 102/521

[58] Field of Search ..... 102/430, 431, 102/501, 503, 506–510, 514, 516–519, 520–523; 244/3.3

[56] References Cited

U.S. PATENT DOCUMENTS

| | | | |
|---|---|---|---|
| 4,043,269 | 8/1977 | Ambrosini | 102/522 |
| 4,135,449 | 1/1979 | Prochnow et al. | 102/517 |
| 4,539,911 | 9/1985 | Flatau | 102/503 |
| 4,788,915 | 12/1988 | Sauvestre | 102/517 |
| 4,827,847 | 5/1989 | Laviolette | 102/503 |
| 4,911,079 | 3/1990 | Sauvestre | 102/439 |
| 5,067,406 | 11/1991 | Olson et al. | 102/503 |

FOREIGN PATENT DOCUMENTS

| | | | |
|---|---|---|---|
| 333542 | 9/1989 | European Pat. Off. . | |
| 2 335 818 | 12/1975 | France . | |
| 2425621 | 12/1979 | France . | |
| 2437603 | 4/1980 | France . | |
| 2555728 | 5/1985 | France . | |
| 2627273 | 8/1989 | France . | |
| 2011148 | 4/1994 | Russian Federation | 102/501 |
| WO9118256 | 11/1991 | WIPO | 102/521 |

*Primary Examiner*—Harold J. Tudor
*Attorney, Agent, or Firm*—Foley & Lardner

[57] ABSTRACT

The invention relates to munitions for weapons of small, medium or large caliber. The munitions include a subprojectile combined with a launcher which fills the bore of the weapon and which detaches under the effect of the aerodynamic forces on leaving the weapon, the assembly being incorporated into a cartridge which furthermore comprises a primed case and a propellent charge. The subprojectile includes a body made of hard material, combined with an axisymmetric element including a front central nozzle communicating with at least two annular nozzles to channel the airflow.

12 Claims, 3 Drawing Sheets

DOUBLE-PENETRATION REDUCED-RANGE HUNTING BULLET

The present invention relates to munitions for weapons of small, medium and large caliber, and more particularly to a new double-penetration reduced-range bullet of the type including a subprojectile combined with a launcher, actuated by a propellent system.

BACKGROUND OF THE INVENTION

Munitions of the flechette type are known in the sporting and military fields and, for example, Patent FR-A-2,335,818 describes a hunting munition which includes a fin-stabilized subcaliber projectile combined with a launcher sabot. The latter is made of a material likely to fragment on leaving the barrel of the weapon, and dispersion of the fragments then represents a risk to the user's safety.

Patent FR-A-2,555,728 describes a munition of the same type, that is to say one which includes a fin-stabilized subprojectile associated with a detachable launcher which has the effect of guiding and sealing it as it travels along the barrel of the weapon. The subprojectile has a tapered shape and is made of a high-density material giving it a high surface energy on impact. However, this characteristic has the drawback of often causing only slight wounding of the game animal, it being possible in fact for the subprojectile to pass through the soft flesh of the game animal without encountering a hard part. Furthermore, the projectile may be driven a long distance if the target is missed, because of its good trajectory stability, and it may then constitute a danger for people in the vicinity.

Patent FR-A-2,627,854 relates to a hunting munition which includes a projectile consisting of an internal element, the front and side walls of which are covered with an external element in the form of a sleeve. The metal internal element includes a head having a neutralizing shape, fastened to a rear rod on which a hammer mass may slide in order to increase the neutralizing effect of the projectile upon impact. However, the external element remains fixed to the internal element over the entire trajectory of the projectile; it cannot be assimilated into a launcher such as used in flechette bullets and cannot afford the same advantages.

In addition, projectiles of this type have the drawback of exhibiting high aerodynamic drag and sensitivity to transverse wind. They also have a certain propensity to ricochets on obstacles such as tree trunks.

SUMMARY OF THE INVENTION

The subject of the present invention is a munition of the flechette type, including a subprojectile combined with a launcher which fills the bore of the weapon and which detaches under the effect of the aerodynamic forces on leaving the barrel of the weapon. The assembly consisting of the subprojectile (or bare bullet) and the launcher are incorporated into a cartridge which furthermore comprises a primed case and a propellent charge. This munition possesses characteristics enabling it to avoid the drawbacks of the aforementioned known projectiles and it may be used especially in hunting weapons as well as military training weapons.

According to one characteristic of the invention, the subprojectile comprises:

a body made of hard material combined with an axisymmetric high-energy element which includes a front central nozzle communicating with at least two annular nozzles channeling the airflow.

In accordance with the present invention, the high-energy element forms the front part of the subprojectile and it preferably consists of a hollow outer element and a solid inner element which are connected together by blades, the inner element preferably having a smaller diameter and lying to the rear of the outer element.

According to a preferred embodiment, the high-energy outer element forms with the conical head of the subprojectile body a central nozzle communicating with the annular nozzles, formed in the axisymmetric high-energy element, around the conical head.

The high-energy element may be made in accordance with the invention in such a way that the outside diameter of its outer element substantially fills the bore of the weapon. In this embodiment, the launcher is placed on the subprojectile, to the rear of the outer high-energy element. According to one variant, the outer high-energy element may itself be subcaliber, but its outside diameter remains greater than that of the body of the subprojectile. In this embodiment variant, the shape of the launcher is designed to cover the subprojectile entirely, that is to say the body and the axisymmetric high-energy element.

The inside diameter of the nozzle-shaped outer high-energy element may be greater than, equal to or less than the outside diameter of the inner high-energy element.

The axisymmetric high-energy element may be separable from the body on which it is mounted but, in a variant, the body and the high-energy element may be made as a single homogeneous piece in the same material.

In addition, the high-energy element may be made so as to be fragmentable upon impact on the target. This effect may be obtained by using a material having an appropriate impact strength, and in this case the body of the subprojectile and the high-energy element are made of two different materials and are joined together during manufacture. For example, provision may be made for the axisymmetric high-energy element to be made of a material having a lower impact strength than the body of the subprojectile made of a hard material. It is also possible to provide fracture initiators in the high-energy element, for example in the region of the connection between the outer element and the inner element, and preferably the base of the blades separating the annular nozzles or in the thickness of the central nozzle. In this embodiment, the body of the subprojectile and the axisymmetric high-energy element may be manufactured as one and the same piece.

Moreover, it is advantageous in accordance with the invention for the front face of the axisymmetric high-energy element to have an inside chamfer. According to another advantageous embodiment, the internal surface of the axisymmetric high-energy element possesses a frustoconical shape in which the inside diameter of its front part is slightly greater than the inside diameter of its rear part.

A complete round (projectile) in accordance with the invention is composed of the two essential elements consisting of the bare bullet (subprojectile) and the launcher.

The launcher may be made according to known techniques and it may be made as a single monobloc or as a plurality of longitudinally contiguous elements. It may also be divided into at least two transversely separate monobloc elements. In accordance with the invention, it may be advantageous for the launcher to include a rear face having a cutout of shape corresponding to the fin assembly of the subprojectile.

A seal may be provided between the body of the bullet (subprojectile) and the launcher and, preferably, an annular seal is installed on a thrust plate located between the head and the fin assembly of the body of the bullet so as to ensure sealing with respect to the propellent gases after the charge has been fired.

The sealing between the launcher and the barrel of the weapon may be achieved, in accordance with the invention, by means of an annular lip formed on the periphery of the rear face of the launcher, or of at least one element of the launcher, in such a way that this annular lip is pressed against the wall of the barrel by the pressure of the gases after the charge has been fired.

The munition in accordance with the present invention has many advantages compared with the known munitions in the same field of application. More particularly, it permits:

generation of wounds in the soft parts of the game animal by fragmentation of the high-energy element in quite a wide fragmentation cone;

rapid penetration of the flechette, consisting of the body and the inner high-energy element, in order to attack the hard parts of the game animal's skeleton and to create a large shock wave;

a reduced range of the bullet, the reduction in range being predetermined and possibly associated with destabilization of the said bullet. This result may be obtained in a known manner by an internal aerodynamic effect;

rapid separation of the launcher, also based on an internal aerodynamic effect;

a monobloc launcher to remain in the plane of firing after it has separated from the bullet;

low propensity of the bullet to ricochets;

improved ballistic dispersion;

reduction in the mass of lead involved;

firing in all full-choke smooth-bore, slightly rifled and highly rifled weapons;

use of the same bullet for various calibers (for example 12, 16, 20, etc. calibers).

Tests carried out with bullets made in accordance with the present invention, compared with known bullets, have demonstrated the excellent results afforded by the invention.

In fact, when the trajectory of a no-nozzle bullet (range a) is compared with that of a bullet with only aerodynamic braking, which bullet is fired under the same conditions (range b), and with that of a bullet in accordance with the invention, with braking by aerodynamic blocking and destabilization over the trajectory (range c), the relationship $c<b<a$ is observed, that is to say that the range is markedly limited in the case of the invention.

The advantage afforded by a braking and destabilization which are associated with the reduced range is particularly useful in the case of practice munitions, while the double penetration of the high-energy element and of the flechette constitutes a major advantage in the case of hunting munitions. Furthermore, the kinetic energy per unit area of these two elements are very high, in accordance with the invention, as indicated hereinbelow.

BRIEF DESCRIPTION OF THE DRAWINGS

The characteristics and advantages of the invention will appear more clearly on reading the following description, with reference to the appended drawings, relating to preferred embodiments, which represent.

These illustrative embodiments all refer to hunting or small-caliber munitions, but it, is clear that the invention may be adapted to practice munitions without departing from the scope of the present description.

DETAILED DESCRIPTION OF THE PREFERRED EMBODIMENTS

Figure 1:
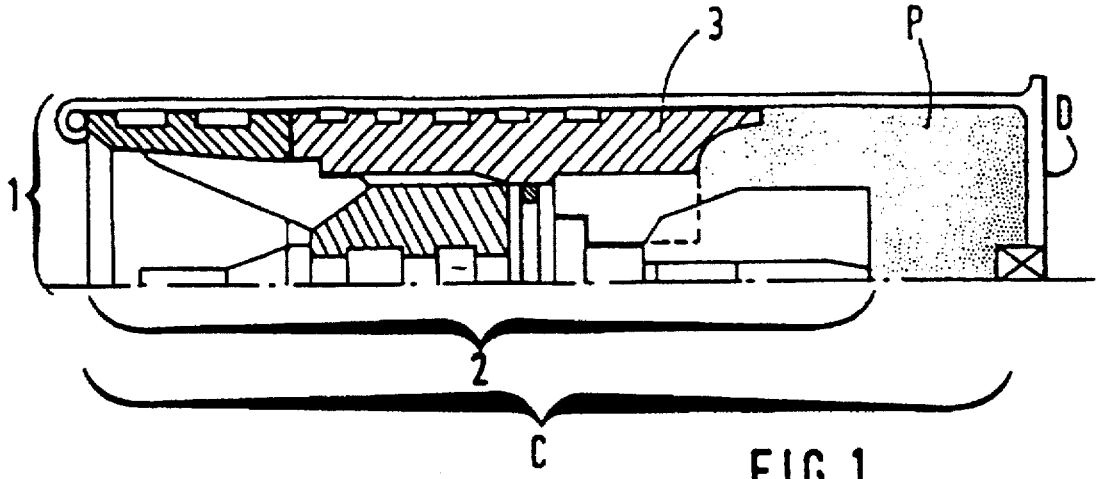
FIG. 1: a diagrammatic section through a complete cartridge in accordance with the present invention, comprising a complete round, consisting of a bare bullet and a launcher, and a primed case as well as a propellent charge.

As shown in FIG. 1, the cartridge (C) comprises the bare bullet (2), the launcher (3) as well as the primed case (D) containing a propellent charge, consisting here of a powder (P) of conventional type.

Figure 2:
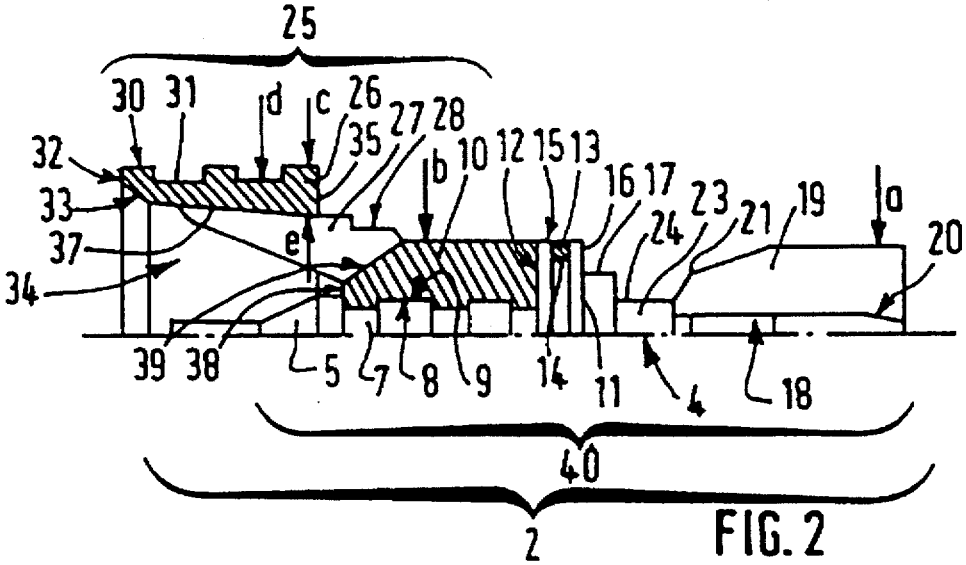
FIG. 2: a longitudinal section through the bare bullet of FIG. 1.

The bare bullet (2), shown in more detail in FIG. 2, includes essentially two elements:

the body (4), made of hard material (for example brass), which includes a conical head (5), a core (7), a thrust plate (11) and a fin assembly (18) serving to stabilize the projectile over its trajectory;

an axisymmetric high-energy element (25) consisting of an inner element (10) and an outer element (26) which are connected together by blades (27), thus forming annular nozzles (6) around the conical head (5), the inner element (10), of smaller diameter, being set back to the rear of the outer element (26).

Figure 3:
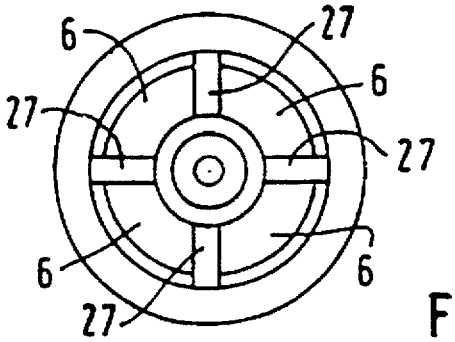
FIG. 3: a front view of a simple variant of the bare bullet of FIG. 2.

The shape of the annular nozzles (6) delimited by the blades (27) is seen more clearly in FIG. 3, showing a bare bullet having an outer element (26) of cylindrical shape and four annular nozzles.

The conical head (5) of the body (4) of the bare bullet (2) is designed in accordance with the present invention to provide several functions, and more particularly to promote airflow through the annular nozzles (6), to permit good catching of the bullet on the targets encountered and to penetrate into the matter with a very high neutralizing power.

The core (7) is provided with keys (8) interacting with the circular grooves (9) in the inner high-energy element (10).

The thrust plate (11) ensures a—integrity of the inner high-energy element (10) at the interface (12) during the phase of propulsion of the bare bullet (3) as well as during the phase of penetration into the target;

b—sealing with respect to the propellent gases between the launcher (3) and the body (4) by virtue of the seal (13) made of deformable material interacting with the groove (14);

c—guiding of the launcher (3) by its cylindrical outer part (15);

d—thrusting of the central part of the bare bullet (2) [body (4)+inner high-energy element (10)] by virtue of the interaction of the rear part of the launcher (3) and of the rear face (16) which itself includes a shoulder (17) so as to permit better guiding of the launcher (3).

The fin assembly (18) serves to stabilize the bare bullet (2) over its trajectory. It is made either in the same material as the body (4), that is to say preferably brass, or in a material of the engineering-polymer type.

The fin assembly conventionally consists of and is composed of:

a—fins (19), the number and shape of which are related to the flight conditions of the bare bullet (2), according to a standard technique. In general, it is preferable for the fin assembly to have four fins. Each fin includes a trailing edge chamfer (20) to permit the bare bullet (2) to rotate slightly over its trajectory. The front (21) of the fins (19) may fit into corresponding grooves made in the launcher (3), thus allowing angular locking of the bare bullet (2) with the launcher (3). The outside diameter (a) of the fins (19) is preferably slightly less than the outside diameter (b) of the inner high-energy element (10) which itself is equal to the outside diameter of the thrust plate (11);

b—a fin-assembly body (23) also serving to guide the launcher (3) at the interface (24).

The high-energy element (25) is made of a dense material, for example lead, but any other high-density metallic material may be suitable, for example a metal alloy of appropriate density or alternatively an organic/metallic hybrid alloy.

The two elements (10) and (26) of the high-energy element (25) are connected together by the blades (27), the number of which depends on the flight characteristics, on the mechanical integrity of the complete round (1) during the propulsion phase as well as on the behavior of the bare bullet (2) upon penetrating the target. The number of blades generally lies between 2 and 8 and is preferably equal to 4. In their outer part, these blades have a step (28) interacting with the internal part (29) of the launcher (3), the latter thus being guided in its front part.

On its outer part, the outer high-energy element (26) includes circular parts (30) as well as slots (31). In order to avoid coating the barrel of the weapon with lead, it is preferable for the circular parts (30) to have a diameter (c) less than or at most equal to the outside diameter of the launcher (3), for the number and width of the said bearing surfaces to be as small as possible and for the slots (31) to have a diameter (d) less than the exit diameter of a "full choke" barrel of the weapon.

The front face (32) of the outer element (26) has as small as possible an area. The latter is influenced by the magnitude of the inside chamfer (33) whose other function is to promote, on the one hand, the penetration of air into the central nozzle (34) and, on the other hand, fragmentation over a wide cone at the start of penetration of the bare bullet (2) into the target by shattering of the element (26).

The rear face (35) of the outer element (26) mates with the front face (36) of the launcher (3) in order to ensure mechanical integrity of the outer high-energy element (26) during the phase of propulsion of the complete round (1). The inner part (37) of the outer element (26) delimits the central nozzle (34) of cylindro-conical shape which interacts with the annular nozzles (6) the number of which is equal to the number of blades (27). The inside diameter (e) of the rear part of the central nozzle (34) can be either greater than, less than or equal to the outside diameter (b) of the inner high-energy element (10) and of that of the thrust plate (11). Of course, this central nozzle (34) may have a simply cylindrical shape of constant inside diameter from the front to the rear.

In order to improve the fragmentation of the outer high-energy element (26), longitudinal fracture initiators, the numbers and shapes of which are different, may be made in the thickness of the cylindrical wall of the element.

The shape of the annular nozzles (6) has curvi-linear contours. The precise dimensioning of the nozzles (34) and (6) is determined by the usual methods in the art, depending on the flight characteristics which it is desired to obtain, on the penetration characteristics in the target as well as on the mechanical integrity of the high-energy element (25) during the phase of launching of the complete round.

The nozzles may have any geometrical shape, for example a square, triangular, round, oblong or conical shape.

The inner high-energy element (10) has an outside diameter (b) less than or at most equal to the inside diameter (e) of the rear part of the central nozzle (34). Over its inside face, it has circular grooves (9) interacting with the keys (8) of the core (7). Its front face (38) comprises a conical part (39) forming the inside part of the annular nozzles (6) so as to be continuous with the conical head (5) of the body (4) of the bare bullet (2). Its rear face mates with the front face of the thrust plate (11) at the interface (12).

The body (4) combined with the inner high-energy element (10) makes up the flechette (40) of the bare bullet (2). The flechette (40) is directed over its entire trajectory right up to the target by the outer high-energy element (26).

Figure 4:
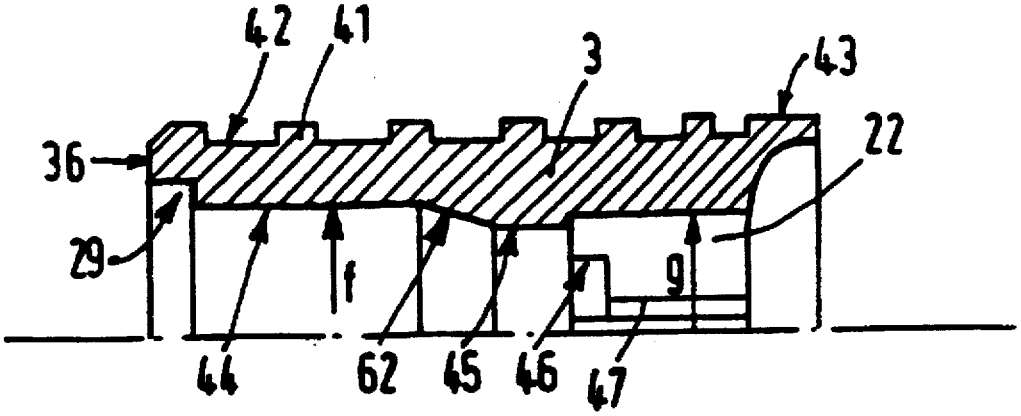
FIG. 4: a section through the launcher combined with the bare bullet shown in FIG. 1.

The launcher (3), shown in FIG. 4, is manufactured from a material having a low density and a high flexibility (for example an engineering polymer such as a polyamide). The launcher (3) is monobloc and can slide freely until it comes in contact with the outer element (26), the step of the blade (27) and the thrust plate (11). On its outside part, it has narrow keys (41) permitting the complete round (1) to be guided in the barrel of the weapon. Decompression slots (42) provide good sealing with respect to the propellent gases, which sealing is also provided to a large part by the lip (43) by pressing of this latter element against the wall of the barrel of the weapon under the effect of the pressure. This arrangement permits firing in all full-choke barrels, without degradation of the ballistic dispersion of the bare bullet (2), and also increases the lifetime of the weapons.

The front face (36) of the launcher (3) interacts with the rear face (35) of the outer high-energy element (26) in order essentially to ensure mechanical integrity of the element (26) during the phase of propulsion of the complete round (1).

On its front part, the inside part of the launcher (3) comprises a step (29) mating with the corresponding step (28) of the blades (27) and thus permitting front guiding of the launcher (3). This launcher (3) has a bore (44) whose inside diameter (f) is greater than that (b) of the inner high-energy element (10) (a few tenths of a millimeter clearance) and a bore (45) interacting with the outside part (15) of the thrust plate (11), thereby making it possible partly to ensure rear guiding of the launcher (3). In addition, the step (46) interacts with the rear face (16) and the shoulder (17) of the thrust plate (11), thus making it possible also partly to ensure rear guiding of the launcher (3) and mechanical integrity of the assembly during the propulsion phase.

The bores (44) and (45) are connected by the conical part (62). The bore (47) interacts with the fin-assembly body (23) and thus makes it possible to improve the rear guiding of the launcher (3). The grooves (22), the number of which is equal to the number of fins (19) of the fin assembly (18), ensure, by interaction with the front part (21) of the fins (19), angular locking of the bare bullet (2) with the launcher (3), the diameter (g) of the bottom of the grooves being slightly greater than the outside diameter (a) of the fins (19).

The operation of the munition in accordance with the present invention is described hereinbelow.

At the start of firing and during the pressure rise, the unfastening of the case takes place by means of the outer high-energy element (26). During the phase of propulsion of the complete round (1), the bare bullet (2) and the launcher (3) are intimately linked. Immediately on leaving the barrel of the weapon, the launcher (3) slides on the bare bullet (2) due to the difference in frictional aerodynamic drag on the bare bullet (2) and on the launcher (3) and to the air pressure which is generated in the central nozzle (34) and in the annular nozzles (6) and which is exerted essentially on the step (29) of the launcher.

The bare bullet (2)/launcher (3) sliding zones have different dimensions, the final point of contact having to take place in front of the center of gravity of the bare bullet (2) and as close as possible to this center of gravity. This arrangement makes it possible partly to compensate for the small perturbations associated with the launcher (3)/bare bullet (2) separation.

The monobloc launcher (3) thus released remains in the plane of firing until it falls to ground, this occurring at an average distance of from 30 to 40 meters from the firer. It thus makes firing completely safe, for example, with respect to other hunters.

Over the trajectory, the bare bullet (2) is stabilized by the fin assembly (18) of the flechette (40), this latter element also fulfilling the role of fin assembly for the outer high-energy element (26).

The central nozzle (34) and the annular nozzles (6) may be dimensioned so as to create aerodynamic blocking or unblocking. Aerodynamic unblocking occurs when, for a given velocity $V_1$, the air flows from the central nozzle (34) to the outside by passing through the annular nozzles (6) under the sole condition that this velocity $V_1$ be greater than the so-called "critical" velocity $V_c$. Aerodynamic blocking occurs at a velocity $V_2$, less than the velocity $V_1$. In this case, air can no longer flow through the nozzles. This aerodynamic blocking is characterized by a large increase in the aerodynamic drag which may be up to a factor of 2, thus leading to a shorter range for the bare bullet (2). Moreover, this aerodynamic blocking causes shifting of the center of the aerodynamic forces applied to the bare bullet (2) toward the center of gravity of the said bullet. Decreasing this distance may lead to complete destabilization of the bullet at a given distance. This phenomenon, associated with a high aerodynamic drag, permits very short ranges to be obtained.

The attack mechanism is executed in two phases:

In a 1st phase, the outer high-energy element (26) strikes firstly the target by means of its front face (32) with the total energy of the bare bullet (2).

At this precise moment, three phenomena occur chronologically:

a—a first neutralizing effect due to the very high kinetic energy per unit area (½ $m \cdot V^2$: annular cross section of the outer high-energy element (26)) thus permitting generation of a large shock wave with dilaceration.

b—a second neutralizing effect by fragmentation of the outer high-energy element (26) over a wide fragmentation cone.

c—release of the flechette (40). This latter element, which is significantly subcaliber compared to the outer high-energy element (26), is not perturbed by the fragmentation of the said element.

In a 2nd phase, the flechette (40), the release of which has absorbed virtually no energy, thus strikes the target with the total energy of the bare bullet (2). As the target has become less hard because of the work produced by the outer high-energy element (26) during the 1st phase, the flechette (40) may easily enter the target with its total energy. Due partly to the inner high-energy element (10), the neutralizing power, from dilaceration, inhibition and fracture of hard parts, is exceptional. It should be noted that, at the moment of penetration into the target, the kinetic energy per unit area of the flechette (40) (½ $m \cdot V^2$: maximum cross section of the body of the flechette) is exceptionally high.

This two-phase attack mechanism makes it possible to obtain very high kinetic energy per unit area of the outer high-energy element (26) and of the flechette (40). The present invention furthermore permits very easy control of the value of the kinetic energy per unit area to be imposed on the outer high-energy (26) and on the flechette (40).

Several examples of munitions in accordance with the invention, produced by conventional manufacturing techniques, are described hereinbelow.

EXAMPLE 1

Characteristics of a 12-caliber bullet:

| | |
|---|---|
| Total mass of the complete round | $M_t$ = 30.0 g |
| Mass of the launcher (3) | $M_L$ = 4.5 g |
| Total mass of the bare bullet (2) | $M_b$ = 25.5 g |
| Mass of the high-energy element (25) | $M_p$ = 18.5 g |
| Mass of the bullet body (4) | $M_c$ = 7.0 g |
| $V_o$ = 500 m/S [sic] | |
| Energies of the bare bullet (2) at the mouth of the barrel: | |
| Kinetic energy: | $E_k$ = 3200 J |
| Kinetic energy per unit area of the outer high-energy element (26): | Ek/ .$S_1$ = 32 J/mm$^2$ |
| Kinetic energy per unit area of the flechette (40) | Ek/ .$S_2$ = 33 J/mm$^2$. |

In this embodiment, virtually identical Ek/.S values may be observed.

Several technological variants of the bullet in accordance with the present invention were manufactured and are specified hereinbelow. Of course, various modifications may be made to them without departing from the scope of the present invention.

EXAMPLE 2

This example describes a launcher made from a plurality of contiguous elements.

Figure 5:
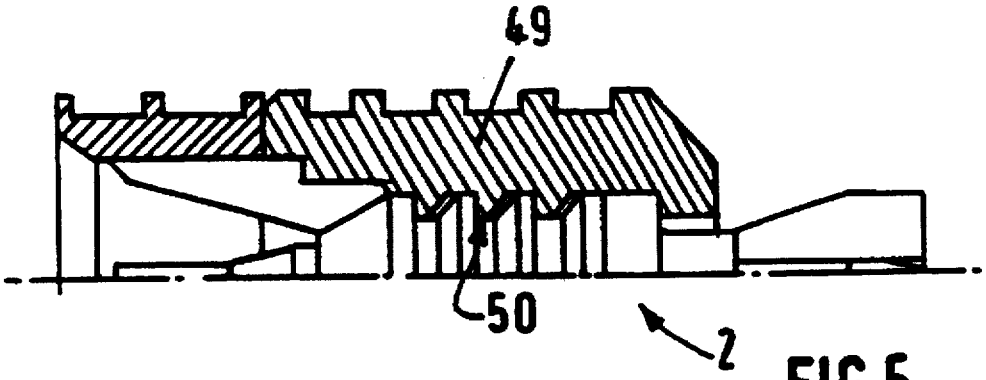
FIGS. 5–8: embodiment variants in accordance with the present invention.

The bare bullet (2) may be fired with a launcher composed of a plurality of elements having contiguous planes, as is shown in FIG. 5.

FIG. 5 describes a complete round provided with such a launcher composed of two elements (49). These latter elements interact with the bare bullet (2) by means of circular grooves (50) and of keys.

Figure 6:
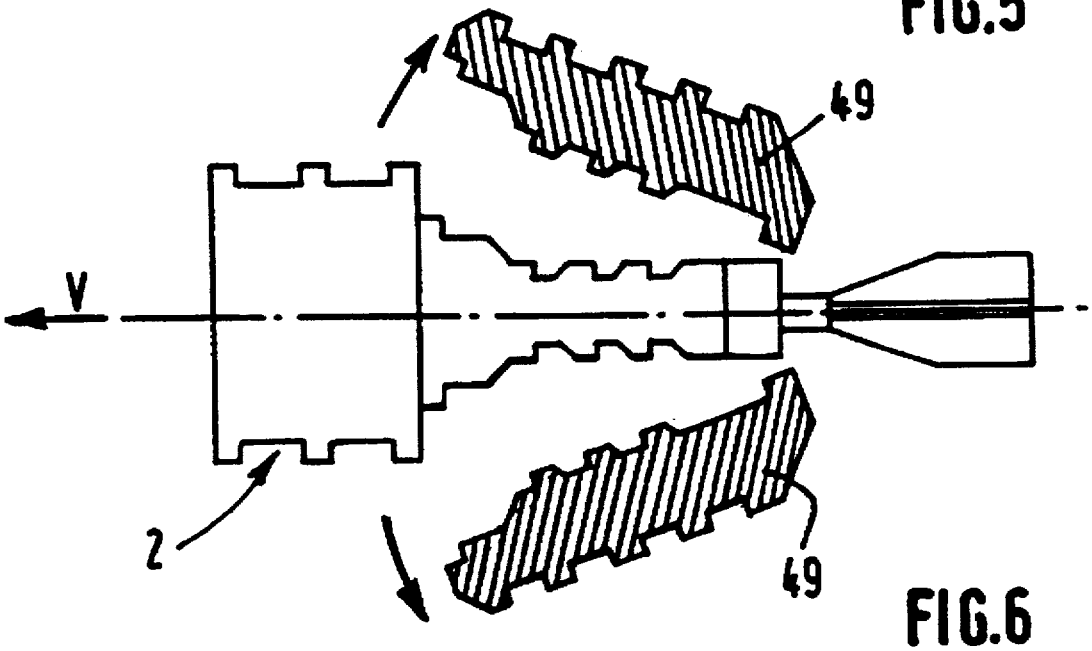

As shown in FIG. 6, under the effect of the aerodynamic components, the elements (49) of the launcher detach from the bare bullet (2) which, released, reaches the target. The elements (49) drop at an average distance of 30 meters, with a maximum deviation of 7 meters with respect to the plane of firing.

EXAMPLE 3

Figure 7:
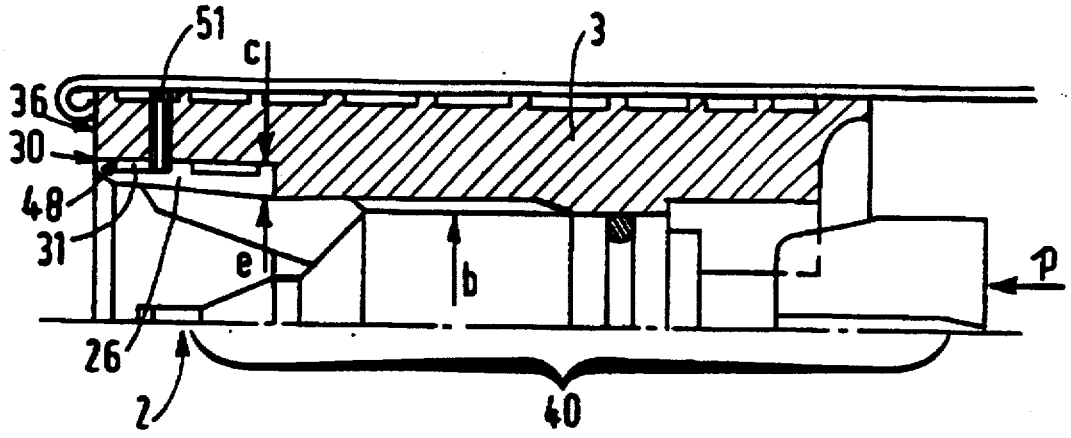

As shown in FIG. 7, the launcher (3) according to the invention is mounted on the bare bullet (2), the outer high-energy element (26) of which has an outside diameter appreciably smaller than the outside diameter of the launcher (3) and an inside diameter substantially equal to the diameter of the body of the flechette (40) (diameter c<outside diameter of the launcher and diameter e=diameter b).

In this configuration, the launcher (3) includes centering (48) which mates with the outer edge of the circular parts (30) of the outer high-energy element (26). The launcher (3) is therefore increased by the height of the element (26). The case is crimped onto the front face (36) of the launcher (3).

In order to prevent the bare bullet (2) from freely leaving the launcher (3) at the start of firing under the uncrimping pressure p, a locking member (51) is placed in front of one of the circular parts (30) of the element (26) and is jammed between the case and the circular slot (31) in the element (26). Since this locking member is longitudinally free, it is therefore released on the outside immediately on leaving the barrel It may thus leave its housing and release the bare bullet (2).

EXAMPLE 4

Figure 8:
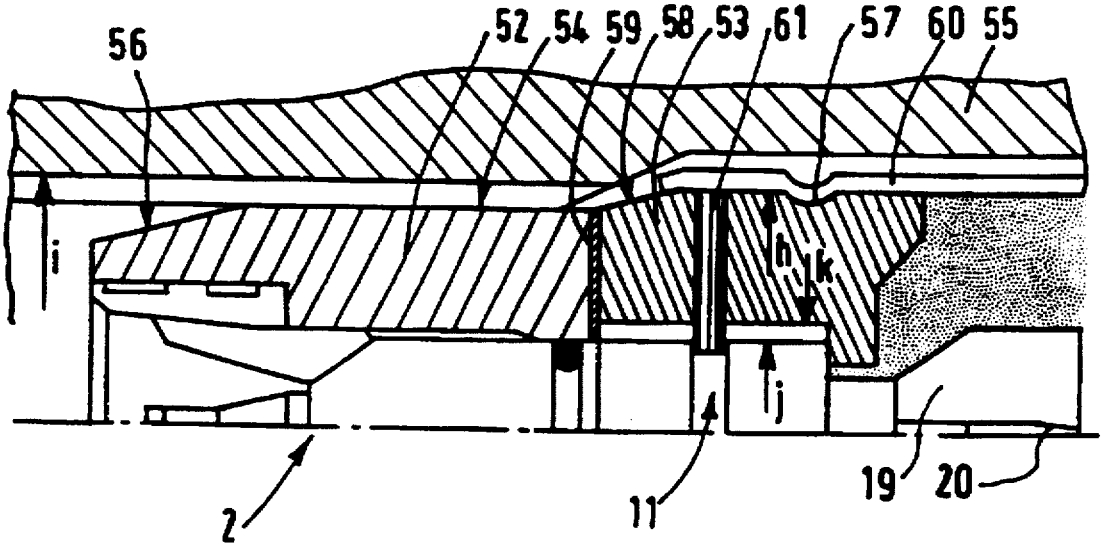

The present invention may also apply to the firing of bullets in highly rifled barrels, as the bullet represented in FIG. 8 shows.

The bare bullet (2) in accordance with the present invention is fin-stabilized. Only a very slight rotation over the trajectory is allowed due to the chamfers (20) made on the trailing edge of the fins (19). In order to preserve this mode of stabilization, it is necessary to overcome the rotational velocity given by a highly rifled barrel.

FIG. 8 describes an illustrative embodiment corresponding to these conditions. In this embodiment, the launcher (3) is divided into two elements in a cross section: the front element (52) and the rear element (53).

The front element (52) is monobloc and axisymmetric. It no longer has circular parts and external decompression slots. Its outside diameter (54) is slightly smaller than the inside diameter of the rifled barrel (55). An outside chamfer (56) is made at the front of this element in order to allow proper insertion of the cartridge. The element (52) may slide freely on the bare bullet (2).

The rear element (53) is also monobloc and axisymmetric. Its outside diameter (h) is very slightly greater than the diameter (i) of the bottom of the rifling of the barrel (55). Its inside diameter (k) is greater (by a few tenths of a millimeter) than the diameter (j) of the thrust plate (11). On its outside part, it also has a crimping slot (57) into which the collar of the metal case (60) fits by deformation.

A chamfer (58) is also made in order to permit proper engagement of the rifling of the said element (53). A bush (59) having a low coefficient of friction is inserted between the two elements (52) and (53). A locking member (61), interacting with the plate (11), provides the same function as that of the locking member (51) described in FIG. 7. It stops the element (53) moving translationally but permits it complete rotational freedom.

The operation of this device is as follows.

As soon as the pressure rises, uncrimping occurs and the bare bullet (2) and the element (52) cannot move forward because they are translationally locked in place by the locking member (51). The element (53) thus takes up the rifling of the barrel (55) and rotates at the speed permitted by this rifling. During its movement, it forces the bare bullet (2) and the element (52) into slight rotation just by friction. On leaving the barrel, the element (53) breaks under centrifugal action, leaving the possibility of the element (52) being released from the bare bullet (2) by sliding.

I claim:

1. A munition for a weapon of small, medium or large caliber, the munition including a cartridge comprising:

a subprojectile including a body and an axisymmetric element having a front central nozzle communicating with at least two annular nozzles, the axisymmetric element forming a front part of the subprojectile and comprising a hollow outer element and a solid inner element, the inner element being connected to the body, the hollow outer element and the solid inner element being connected together by at least two blades;

a launcher initially operatively engaged with the subprojectile and filling a bore of the weapon;

a primed case surrounding the subprojectile and the launcher; and a propellant charge within the primed case;

wherein the launcher detaches from the subprojectile upon leaving the weapon due to aerodynamic forces acting on the launcher; and wherein the front central nozzle and the annular nozzles channel airflow through and around the subprojectile.

2. A munition as claimed in claim 1, wherein the solid inner element has an outside diameter less than or equal to an inside diameter of the hollow outer element, and the hollow outer element is located in front of the solid inner element.

3. A munition as claimed in claim 1, wherein the solid inner element has an outside diameter greater than or equal to an inside diameter of the hollow outer element, and the hollow outer element is located in front of the solid inner element.

4. A munition as claimed in claim 1, wherein the subprojectile further comprises a conical head, and the hollow outer element has a front part, the conical head and the front part forming the central nozzle communicating with the annular nozzles.

5. A munition as claimed in claim 1, wherein the axisymmetric element has a front face having a chamfer.

6. A munition as claimed in claim 1, wherein the axisymmetric element comprises a material having a lower impact strength than a material of the body of the subprojectile.

7. A munition as claimed in claim 1, wherein the launcher comprises a single monoblock element.

8. A munition as claimed in claim 1, wherein the launcher comprises a plurality of longitudinally contiguous elements.

9. A munition as claimed in claim 1, wherein the launcher comprises at least two monoblock elements.

10. A munition as claimed in claim 1, the subprojectile further comprising a fin assembly operatively engaging a rear end of the body; and wherein the launcher includes a rear face having a cutout corresponding to a shape of the fin assembly.

11. A munition as claimed in claim 10, wherein the body of the subprojectile includes a head portion, and a thrust plate is located between the head portion and the fin assembly, the thrust plate abutting an annular seal.

12. A munition as claimed in claim 10, wherein an annular lip extends from the rear face of the launcher.

* * * * *